US010697270B2

(12) United States Patent
Lundheim et al.

(10) Patent No.: US 10,697,270 B2
(45) Date of Patent: Jun. 30, 2020

(54) ANNULUS ISOLATION VALVE ASSEMBLY

(71) Applicant: Aker Solutions AS, Lysaker (NO)

(72) Inventors: Lars Timberlid Lundheim, Borgen (NO); Christer Bolander, Valbo (SE); Kris Oliaro, Aberdeen (GB); Greig Petrie, London (GB)

(73) Assignee: Aker Solutions AS, Lysaker (NO)

( * ) Notice: Subject to any disclaimer, the term of this patent is extended or adjusted under 35 U.S.C. 154(b) by 155 days.

(21) Appl. No.: 15/738,199

(22) PCT Filed: Jun. 27, 2016

(86) PCT No.: PCT/NO2016/050141
§ 371 (c)(1),
(2) Date: Dec. 20, 2017

(87) PCT Pub. No.: WO2017/007332
PCT Pub. Date: Jan. 12, 2017

(65) Prior Publication Data

US 2018/0187513 A1 Jul. 5, 2018

(30) Foreign Application Priority Data

Jul. 3, 2015 (NO) ..... 20150862

(51) Int. Cl.
*E21B 34/04* (2006.01)
*E21B 33/035* (2006.01)
(Continued)

(52) U.S. Cl.
CPC ..... *E21B 34/04* (2013.01); *E21B 33/035* (2013.01); *E21B 33/043* (2013.01);
(Continued)

(58) Field of Classification Search
CPC ..... E21B 34/04; E21B 34/102; E21B 34/10; E21B 34/14; E21B 33/03; E21B 33/04;
(Continued)

(56) References Cited

U.S. PATENT DOCUMENTS 4,848,457 A 7/1989 Lilley
5,503,230 A 4/1996 Osborne et al.
(Continued)

FOREIGN PATENT DOCUMENTS

EA 021887 B1 9/2015
EP 2153017 B1 8/2017
(Continued)

OTHER PUBLICATIONS

Al-Amiri, Thamir Jassim, "International Search Report," prepared for PCT/NO2016/050141, dated Sep. 29, 2016, four pages.

*Primary Examiner* — David Carroll
(74) *Attorney, Agent, or Firm* — Winstead PC

(57) ABSTRACT

An annulus isolation valve assembly being part of a tubing hanger assembly, with a valve bore having a fluid mouth, and a sliding sleeve which is arranged in the valve bore and which has an axially extending sleeve bore. The sliding sleeve has a radially facing sleeve port. A hydraulic piston is functionally connected to the sliding sleeve. The sliding sleeve comprises an axially facing fluid port which is in fluid communication with the radially facing sleeve port.

3 Claims, 11 Drawing Sheets

(51) Int. Cl.

| | |
|---|---|
| ***E21B 34/10*** | (2006.01) |
| ***E21B 33/043*** | (2006.01) |
| *E21B 34/14* | (2006.01) |
| *E21B 34/00* | (2006.01) |

(52) U.S. Cl.
CPC ..... *E21B 34/102* (2013.01); *E21B 34/10* (2013.01); *E21B 34/14* (2013.01); *E21B 2034/007* (2013.01)

(58) Field of Classification Search
CPC ... E21B 33/043; E21B 33/035; E21B 33/0415
See application file for complete search history.

(56) References Cited

U.S. PATENT DOCUMENTS

| | | | | |
|---|---|---|---|---|
| 5,706,893 | A | 1/1998 | Morgan | |
| 5,769,162 | A | 6/1998 | Bartlett et al. | |
| 6,840,323 | B2 | 1/2005 | Fenton et al. | |
| 2003/0150620 | A1* | 8/2003 | DeBerry | E21B 33/043 166/368 |
| 2004/0140125 | A1 | 7/2004 | Dezen et al. | |
| 2012/0160513 | A1 | 6/2012 | Bryson | |
| 2015/0114619 | A1 | 4/2015 | Fenwick | |
| 2015/0277452 | A1* | 10/2015 | Kristensen | E21B 33/035 137/12 |
| 2016/0326838 | A1* | 11/2016 | Porter | E21B 33/04 |

FOREIGN PATENT DOCUMENTS

| | | | |
|---|---|---|---|
| WO | WO-01/73256 | A1 | 10/2001 |
| WO | WO-2008137340 | A1 | 11/2008 |
| WO | WO-2010022170 | A1 | 2/2010 |
| WO | WO-2011002676 | A2 | 1/2011 |

* cited by examiner

ANNULUS ISOLATION VALVE ASSEMBLY

The present invention relates to an annulus isolation valve assembly associated with the tubing hanger of a subsea well assembly. The annulus isolation valve is adapted to open and close for fluid communication with the tubing annulus of a subsea well, and to constitute a well barrier when closed.

BACKGROUND

A plurality of annulus isolation valve designs are known. An annulus isolation valve is sometimes referred to as a tubing annulus valve, or an annulus access valve etc. Arranged in the tubing hanger, the annulus isolation valve constitutes a well barrier between the tubing annulus and the environment when there is no subsea Xmas tree installed above the tubing hanger. When the subsea Xmas tree is installed above the tubing hanger, the annulus isolation valve should be open, leaving a fluid path open between the tubing annulus and the Xmas tree.

One design is shown in international application publication WO0173256. Here, a tubing hanger has an annulus isolation valve in the form of a gate valve. The gate is adapted to reciprocate in the vertical direction, between an open and closed valve position. A fluid path extends crosswise to the reciprocating direction of the gate, and is opened and closed by moving the gate.

A different design is shown in patent publication U.S. Pat. No. 6,840,323. Here, a fixed valve seat is arranged inside the bore of a valve sleeve. By moving the valve sleeve, the fixed valve seat is moved, with respect to the valve sleeve, from a large diameter portion to a small diameter portion. When in the small diameter portion, the fixed valve seat seals against the valve sleeve, thereby closing the fluid path. Notably, fluid flows through the valve sleeve bore. Moreover, the fluid flows directly in contact with the seals of the valve seat and the opposite sealing surface of the sleeve bore.

Yet another design is disclosed in US patent publication U.S. Pat. No. 5,706,893. This valve resembles a gate valve, where the gate protrudes horizontally out from a centrally arranged and rotating sleeve. The gate has an aperture which is aligned with a vertical flow path when in the open position, and which is removed from the vertical flow path when in the closed position.

WO2010022170 describes a design where an axially moving valve sleeve is arranged in parallel with a flow bore. The valve sleeve is hollow and exhibits an upper and a lower aperture. In a first (open) axial position, the upper aperture is aligned with a flow port communicating with the flow bore, while the lower aperture communicates with the tubing annulus. In a second (closed) axial position, the both the upper and the lower apertures are aligned with a cylindrical wall, within which the valve sleeve is supported.

The invention

According to a first aspect of the present invention, there is provided an annulus isolation valve assembly being part of a tubing hanger assembly, the annulus isolation valve assembly (AIV assembly) comprising a valve bore with a fluid mouth. The AIV assembly further comprises a sliding sleeve which is arranged in the valve bore and which has an axially extending sleeve bore. The sliding sleeve comprises a radially facing sleeve port. A hydraulic piston is functionally connected to the sliding sleeve. According to the first aspect of the present invention, the sliding sleeve comprises an axially facing fluid port which is in fluid communication with the radially facing sleeve port.

The annulus isolation valve assembly being part of a tubing hanger assembly, means that it is either an integrated part of the tubing hanger, such as integrated within the tubing hanger main body, or that it may be attached to the tubing hanger main body, such as below it.

The annulus isolation valve assembly will be in an open mode or position when the sleeve port is aligned with or at least has fluid communication with the fluid mouth. Thus, the sliding sleeve can be slid into and out from such an open mode, thereby opening and closing the annulus isolation valve.

The fluid path through the valve assembly, when in the open mode, extends through the sliding sleeve. In particular, the fluid path through the sliding sleeve extends between an axially facing port and a radially facing port (the sleeve port). As a consequence, a pressure in the fluid will exert a force onto the sliding sleeve. Thus, the operator will be able to actuate movement of the sliding sleeve by controlling the pressure in the fluid entering the axially facing port.

Advantageously, the AIV assembly further comprises a primary hydraulic opening chamber and a primary hydraulic closing chamber.

Preferably, the sleeve port is arranged, in the axial direction, between the axially facing fluid port and a closed sleeve end portion. A secondary hydraulic closing chamber is then confined by at least the closed sleeve end portion, a first end of the valve bore, and the valve bore.

That is, the secondary hydraulic closing chamber can advantageously be axially confined by the closed sleeve end portion and the first and of the valve bore, and radially confined by the walls of the valve bore.

One can also imagine embodiments where the primary and secondary hydraulic closing chambers have switched places. In such embodiments, the chamber between the closed sleeve end portion and the first end of the valve bore would be the primary hydraulic closing chamber, which would be used by the operator during normal use.

In some embodiments, the AIV assembly may be arranged with a vertical or inclined orientation. Then, the first end of the valve bore is a lower valve bore end. Moreover, a fixed insertion sleeve extends into the sleeve bore and defines a wall portion of the primary hydraulic opening chamber. The hydraulic piston is a collar protruding radially out from the sliding sleeve.

In a particular embodiment, a piston compensator is in fluid communication with the primary hydraulic closing chamber or the secondary hydraulic closing chamber. Moreover, the piston compensator comprises a position indication means.

With such an embodiment, the operator is able to establish the position of the sliding sleeve by inspection of the position indication means.

In one embodiment, the first end of the valve bore is in a valve body which is attached to a lower portion of a main body of the tubing hanger assembly. The valve body may preferably be attached to the main body of the tubing hanger by means of bolts, thus being easily detachable.

According to a second aspect of the present invention, there is provided a method of shifting an annulus isolation valve assembly of a tubing hanger assembly from a closed mode to an open mode, wherein the tubing hanger assembly is installed in a subsea wellhead assembly, below a subsea Xmas tree. The annulus isolation valve assembly constitutes a closure between a tubing annulus and an annulus bore of the subsea Xmas tree, wherein the method comprises the following steps a) bleeding off a primary hydraulic closing chamber;

b) applying a fluid pressure in the annulus bore of the subsea Xmas tree, thereby forcing a sliding sleeve of the annulus isolation valve assembly downwards from a closing position to an open position.

When installed in the subsea wellhead assembly, the tubing hanger assembly is typically installed inside a wellhead or in a tubing head spool between the wellhead and the subsea Xmas tree.

Step a) may further comprise bleeding off a secondary hydraulic closing chamber.

According to a third aspect of the present invention, there is provided a method of determining or verifying an open mode of an annulus isolation valve assembly of a tubing hanger assembly installed in a wellhead assembly below a subsea Xmas tree. The annulus isolation valve assembly has a hydraulic closing chamber and a hydraulic opening chamber. The method comprises the following steps:

a) after having moved a sliding sleeve from a closing position into an open position by applying hydraulic pressure in the hydraulic opening chamber, ventilating the hydraulic closing chamber;

b) then sealing off the hydraulic closing chamber;

c) applying hydraulic pressure in the hydraulic opening chamber while monitoring fluid pressure in the hydraulic closing chamber.

To perform this method, a pressure gauge may be arranged in a position to measure the fluid pressure of the hydraulic closing chamber during step c. If the measured pressure changes above a threshold value, it is an indication of the sliding sleeve not having landed in the open position. If the pressure change is below the threshold value, it is an indication of a non-moving sliding sleeve, hence indicating that the repeated pressurizing of the hydraulic opening chamber does not affect the sliding sleeve. This is further an indication of the sliding sleeve being in the open position.

EXAMPLE OF EMBODIMENT

While the present invention has been described in general terms above, an example of embodiment is presented in the following. The embodiment is discussed with reference to the drawings, in which FIG. 1 is a cross section view of a tubing hanger assembly comprising an annulus isolation valve assembly according to the invention, which is in a closed mode;

Figure 1:
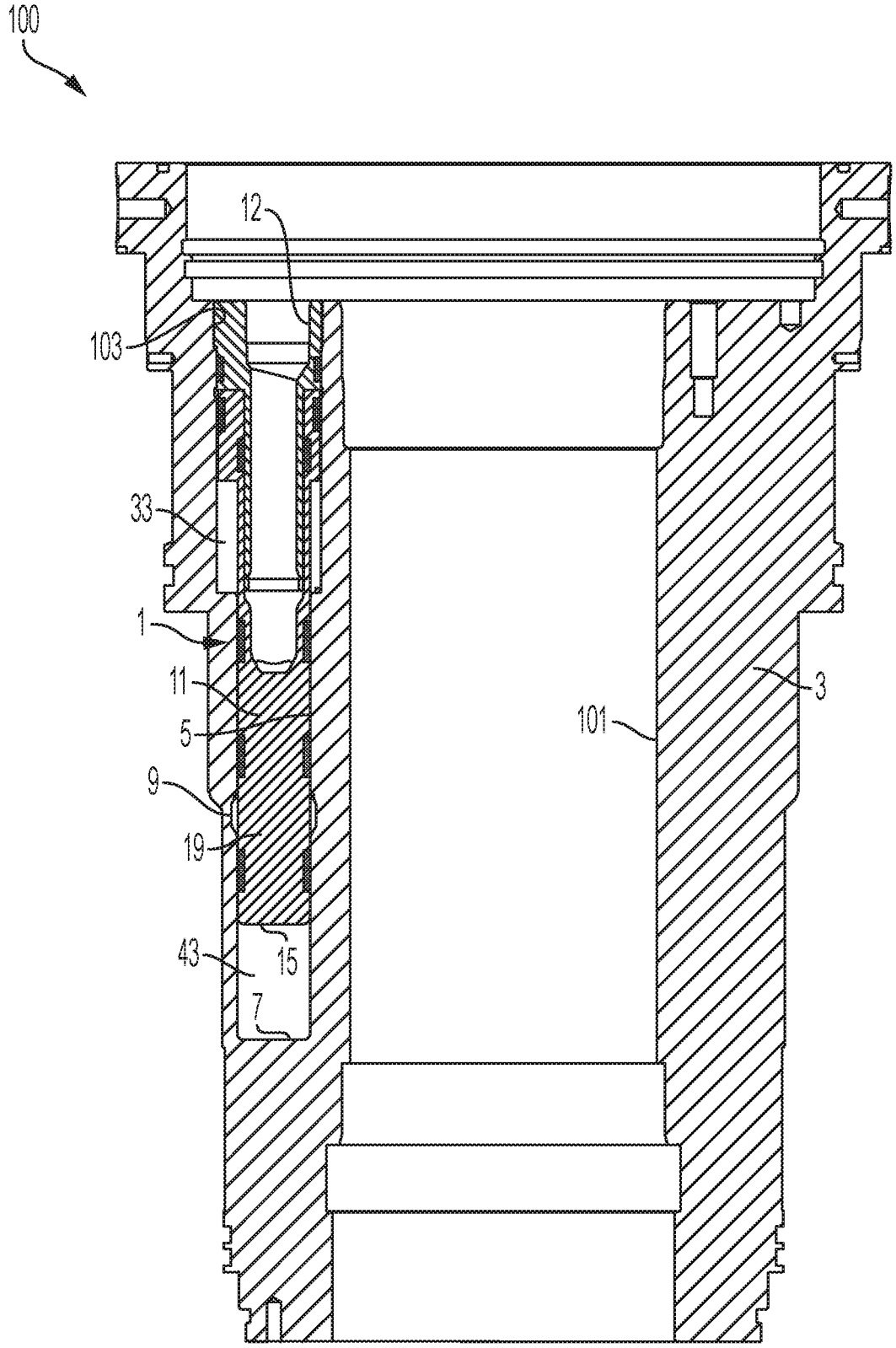

FIG. 1 is a cross section side view of a tubing hanger 100. The tubing hanger 100 is typically configured to be part of a wellhead assembly (not shown), including a wellhead on top of a subsea well, and a subsea Xmas tree above the wellhead. The tubing hanger 100 shown in FIG. 1 will be landed in the wellhead assembly below the Xmas tree, such as in a wellhead or in a tubing head spool between the wellhead and the Xmas tree. When in use, a production tubing will depend down from the tubing hanger, into the subsea well.

Arranged in the tubing hanger 100 is a production bore 101. Moreover, adjacent the production bore 101, in the tubing hanger main body, there is an annulus access bore 103. The annulus access bore 103 provides fluid communication between the production tubing annulus below the tubing hanger 100 and the Xmas tree above the tubing hanger.

When the Xmas tree is landed above the tubing hanger 100, a stinger (not shown) extends downwards from the Xmas tree and into a stinger interface 12, arranged in the upper portion of the tubing hanger 100.

When the Xmas tree is not installed above the tubing hanger 100, the access to the tubing annulus must be closed. Thus, an annulus isolation valve (AIV) assembly 1 is arranged within the annulus access bore 103.

Figure 2:
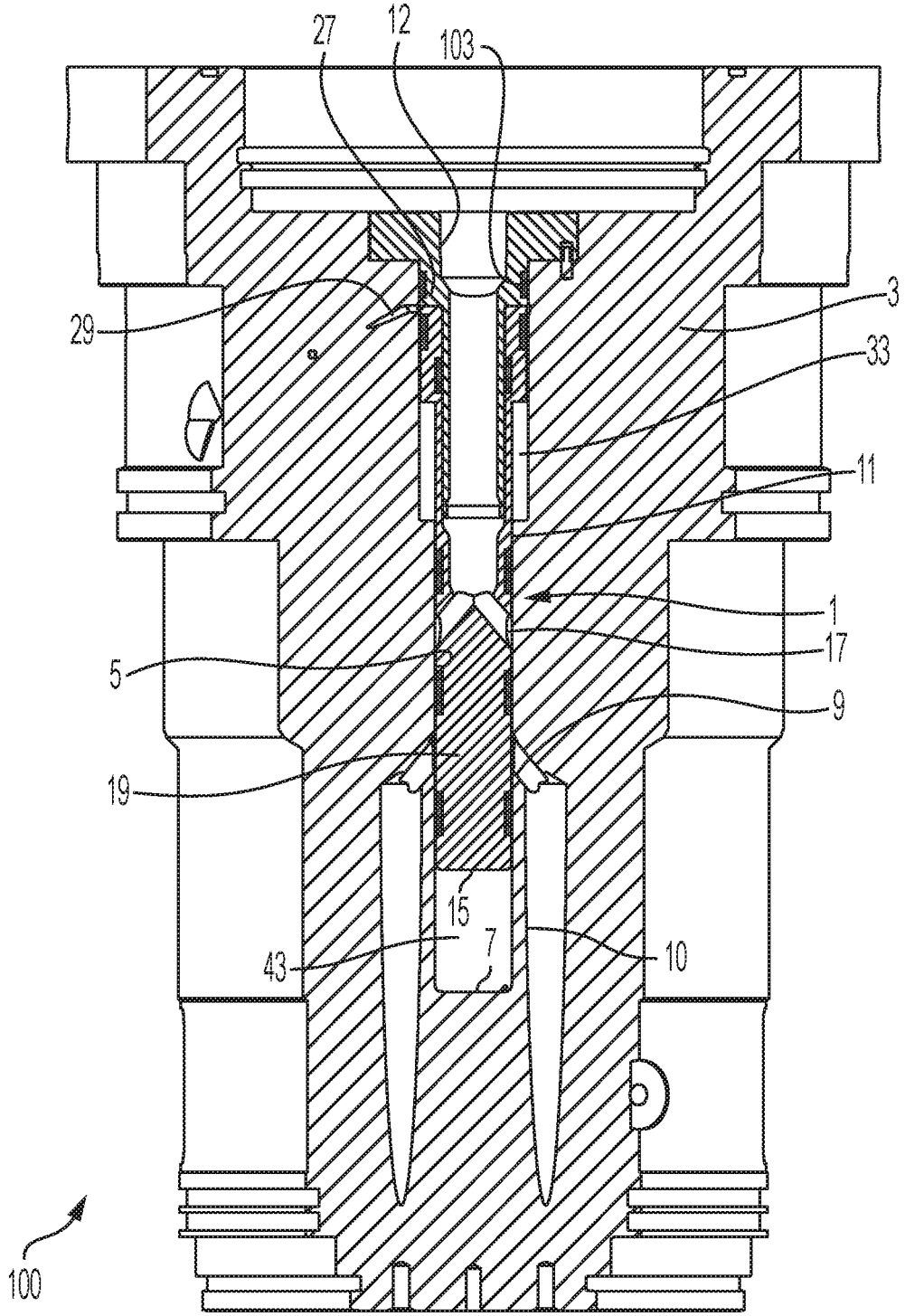
FIG. 2 is a cross section view of the tubing hanger assembly shown in FIG. 1, seen in a direction perpendicular to the view shown in FIG. 1.

FIG. 2 shows the same tubing hanger 100 as shown in FIG. 1, with a side cross section view through the AIV assembly 1, seen in a direction perpendicular to the view shown in FIG. 1. The AIV assembly 1 comprises a sliding sleeve 11, which is supported in a valve bore 5. The sliding sleeve 11 is adapted to be moved axially within the valve bore 5, between an open and closed position. I.e. the AIV assembly 1 is in an open mode when the sliding sleeve 11 is in the open position, and in a closed mode when the sliding sleeve 11 is in the closed position. This will be explained in detail further below.

When moving between the open and closed positions, respectively, the sliding sleeve 11 alters between an open and closed fluid communication to a lower valve channel 10. The lower valve channel 10 constitute at least a portion of a fluid path leading to the tubing annulus.

Figure 3:
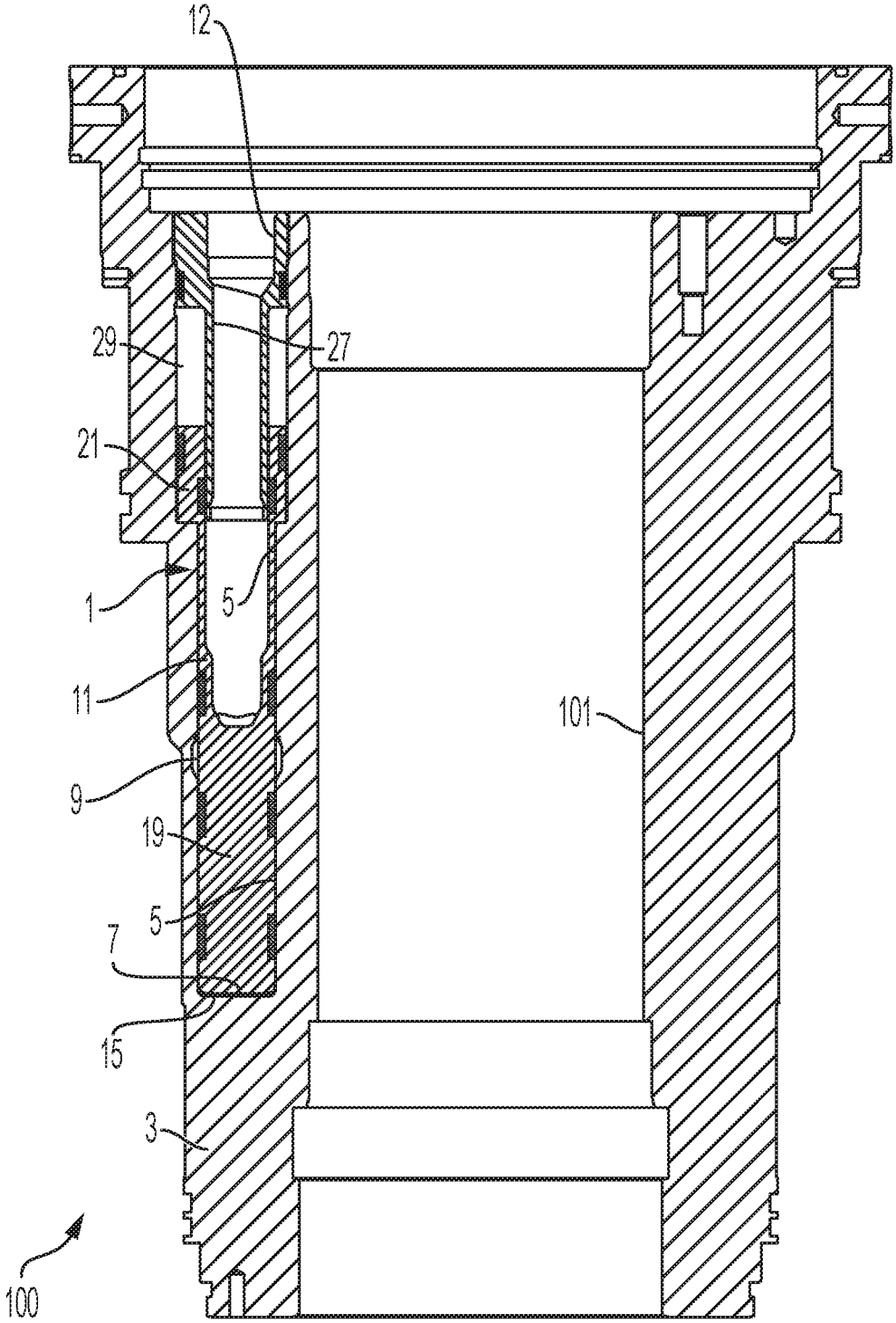
FIG. 3 is the same view as in FIG. 1, however showing the annulus isolation valve assembly in an open mode.
Figure 4:
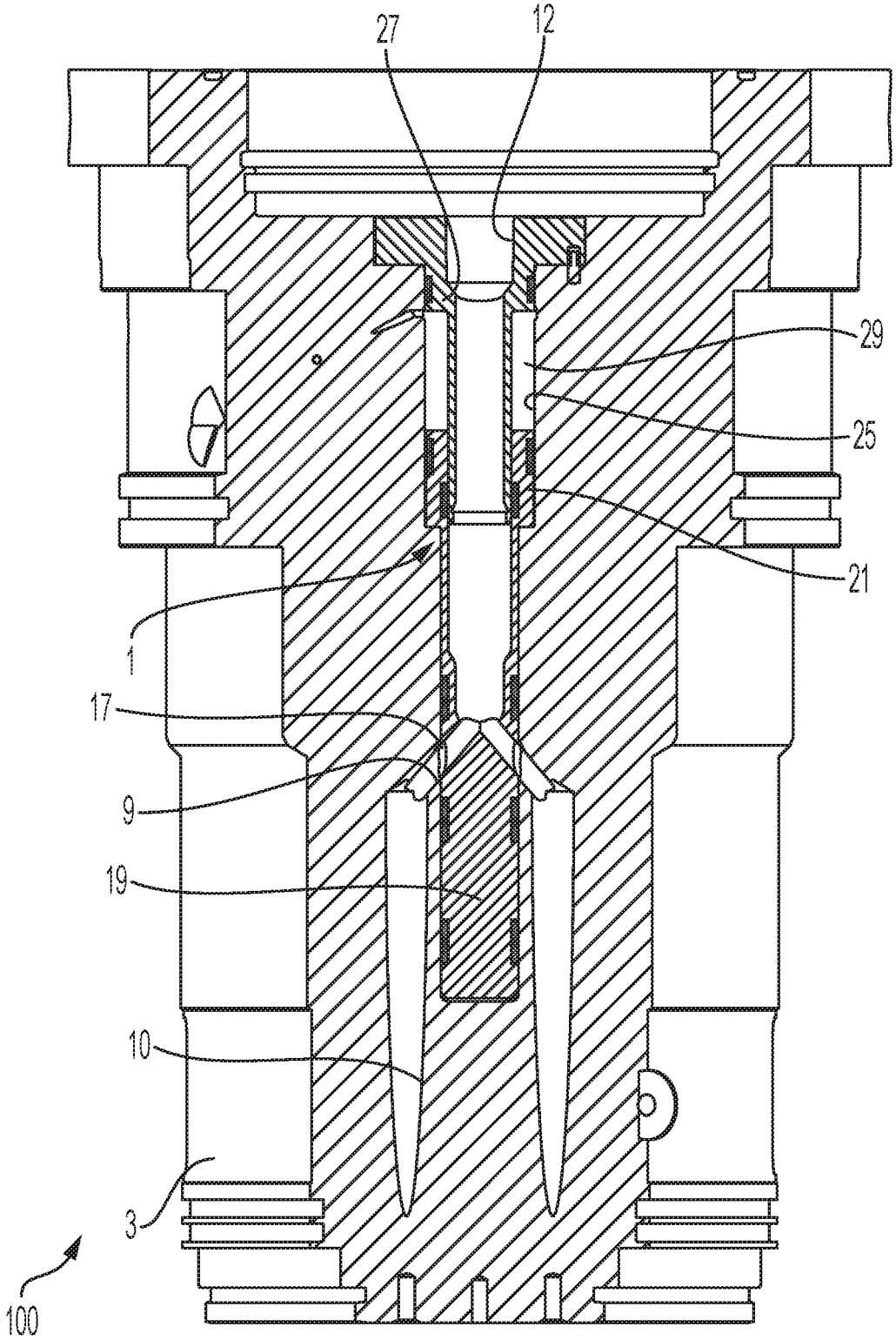
FIG. 4 is the same view as in FIG. 2, however showing the annulus isolation valve assembly in an open mode.

While FIG. 1 and FIG. 2 illustrate the AIV assembly 1 in the closed mode, the corresponding views of FIG. 3 and FIG. 4, respectively show the AIV assembly 1 in the open mode. As will be appreciated by the skilled person, in FIG. 3 and FIG. 4, the sliding sleeve 11 is in a lower position, compared to its position in FIG. 1 and FIG. 2.

Figure 5:
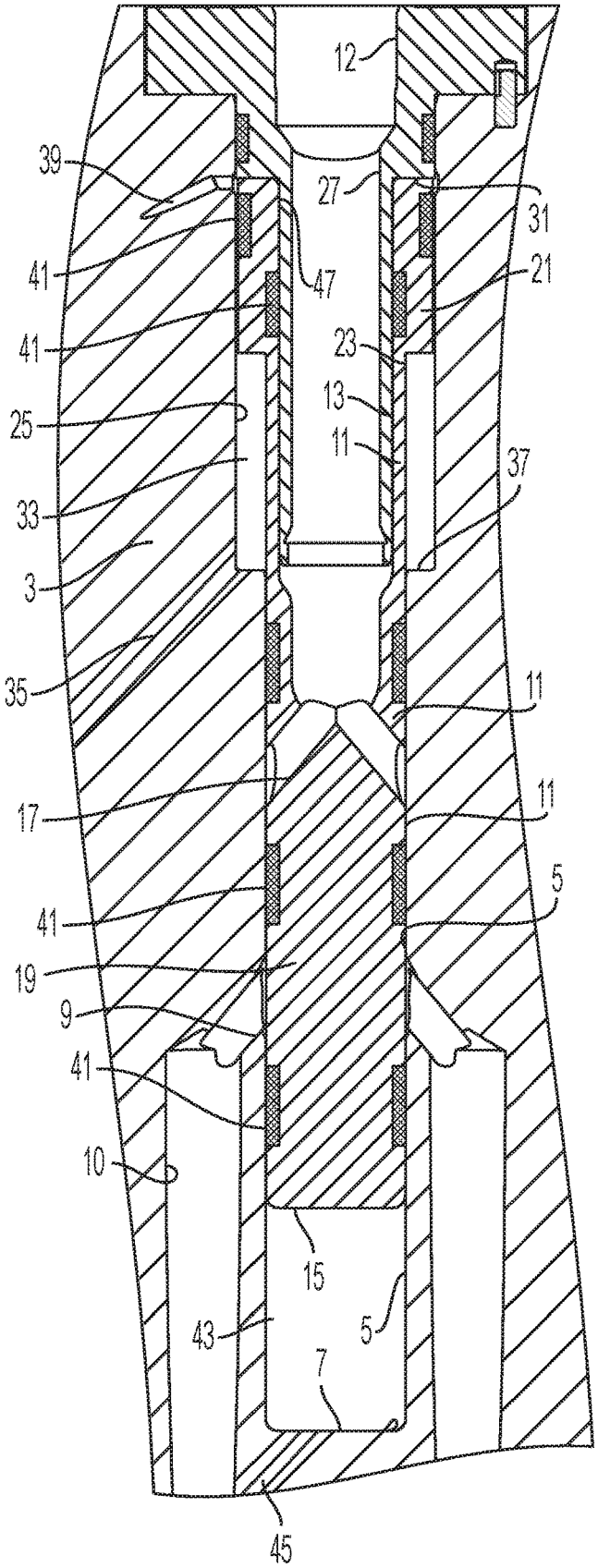
FIG. 5 is an enlarged cross section view of the annulus isolation valve assembly shown in the preceding figures, shown in a closed mode.
Figure 6:
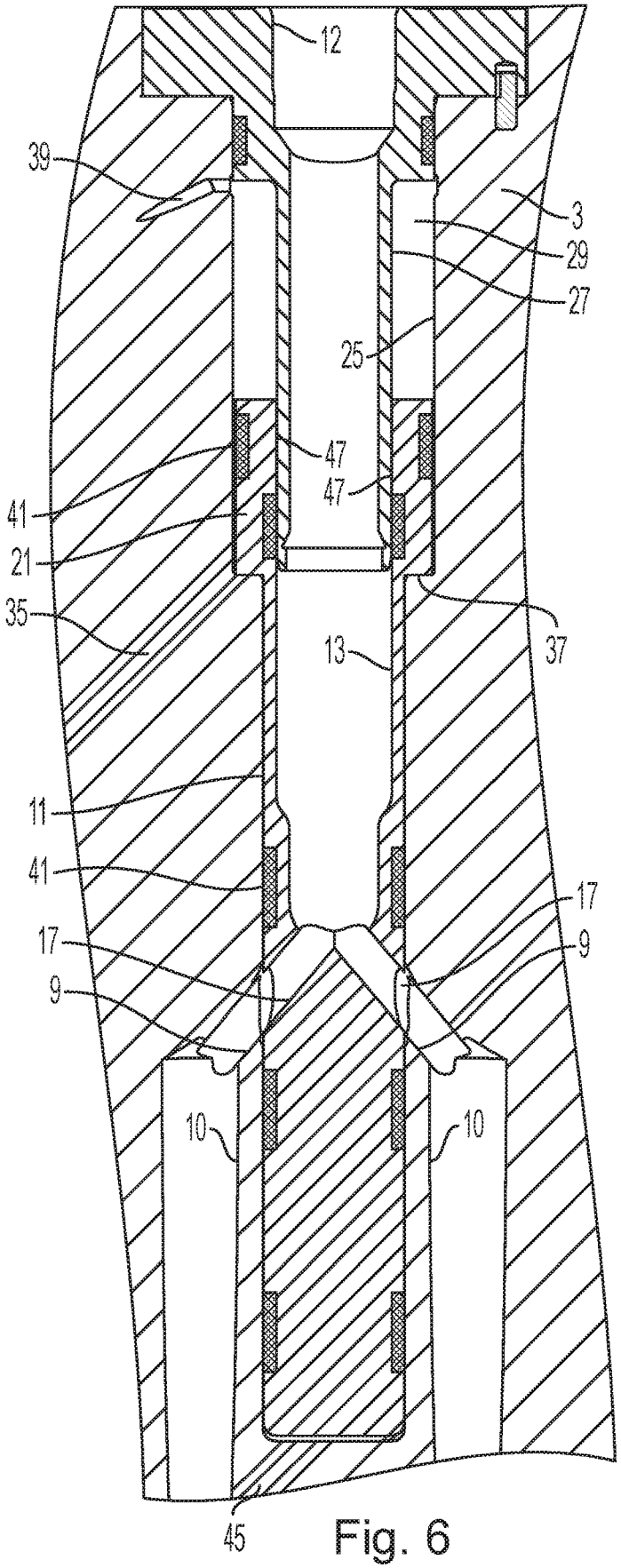
FIG. 6 is an enlarged cross section view of the annulus isolation valve assembly corresponding to FIG. 5, however shown in an open mode.

It is now referred to the enlarged cross section views of FIG. 5 and FIG. 6, for a more detailed description of the function of the AIV assembly 1 according to an embodiment of the invention.

FIG. 5 depicts the annulus isolation valve (AIV) assembly 1, as shown in the closed mode in FIG. 1 and FIG. 2.

Within the tubing hanger main body 3 a valve bore 5 is arranged. The valve bore 5 has a closed, lower end 7. Some axial distance above the lower end 7, the valve bore 5 has two fluid mouths 9. The fluid mouths 9 are in fluid connection with the annulus, via a lower valve channel 10. In the shown embodiment, the AIV assembly 1 comprises two fluid mouths 9 which are aligned with respective sleeve ports 17 of the sliding sleeve 11. In other embodiments, there may be only one pair of a fluid mouth 9 and a port 17, or even more than two.

Inside the valve bore 5, the sliding sleeve 11 is arranged. The sliding sleeve 11 is adapted to reciprocate in an axial (vertical) direction within the valve bore 5. The sliding sleeve 11 has a sleeve bore 13 and a lower sleeve end 15. Some distance above the lower sleeve end 15, the through sleeve port 17 is arranged in the sleeve bore 13. In FIG. 5, the sleeve port 17 is aligned with a wall portion of the valve bore 5. By moving the sliding sleeve 11 axially downwards, the sleeve port 17 can be aligned with the fluid mouth 9. Such a position is shown in FIG. 6. When in this aligned position (FIG. 6), the AIV assembly 1 is in the open mode, giving access to the tubing annulus.

In the shown embodiment, below the sleeve ports 17, the sliding sleeve 11 has a lower sleeve portion 19 which is massive (having no bores). Thus, the lower sleeve portion 19 is a closed sleeve end portion. Above the sleeve ports 17, the sleeve bore 13 extends upwards. At an upper portion of the sleeve bore 13 there is arranged a hydraulic piston 21 which protrudes radially outwards from a sleeve bore wall 23. The hydraulic piston 21 can move between an upper and lower position, along a hydraulic chamber bore 25, which is a widened portion of the valve bore 5.

Fixed to the main body 3 of the tubing hanger 100, there is a fixed insertion sleeve 27, which extends a distance into the sleeve bore 13. The fixed insertion sleeve 27 has an inner bore which is open in both axial ends. Moreover, it extends axially in parallel to the hydraulic chamber bore 25. The upper part of the sleeve bore 13 constitutes an axially facing fluid port 47. When in the open mode, annulus fluid may flow through the AIV assembly through the axially facing fluid port 47. As shown in FIG. 5, the fixed insertion sleeve 27 extends into the sleeve bore 13 through the axially facing fluid port 47.

It is now referred to FIG. 6, showing the open mode of the AIV assembly 1. The AIV assembly 1 has a primary hydraulic opening chamber 29, which is radially confined by the hydraulic chamber bore 25 and the fixed insertion sleeve 27, and axially confined by the hydraulic piston 21 and an upper shoulder 31 of the fixed insertion sleeve 29.

Referring again to FIG. 5, a primary hydraulic closing chamber 33 is radially confined between the hydraulic chamber bore 25 and the sliding sleeve 11, and axially confined by the hydraulic piston 21 and a piston landing shoulder 37 in the valve bore 5.

A primary hydraulic closing channel 35 leads to the primary hydraulic closing chamber 33, through the main body 3 of the tubing hanger 100. Correspondingly, primary hydraulic opening channel 39 leads to the primary hydraulic opening chamber 29. Thus, by applying pressurized hydraulic fluid to the respective primary hydraulic chambers 29, 33, the operator is able to actuate the AIV assembly 1 between the open and closed positions (FIG. 6 and FIG. 5, respectively). Bi-directional seals 41 are appropriately arranged between the outer surface of the sliding sleeve 11 and the valve bore 5. A seal 41 is also provided between the sleeve bore and the fixed insertion sleeve 27. The bi-directional seals 41 may be composed of a pair of oppositely directed unidirectional seals. A skilled person will be able to provide appropriate type of seals as necessary.

The hydraulic fluid can be supplied in various manners, such as with an ROV (remotely operated vehicle), an SCM (subsea control module) or with other interfaces.

Typically, one wants the AIV assembly 1 to be in the open position or mode, when a vertical Xmas tree (not shown) is arranged above the tubing hanger 100. Moreover, when the vertical Xmas tree is removed, one wants the AIV assembly 1 to remain closed, constituting a well barrier.

Thus, the ability of closing the AIV assembly 1 is crucial. Therefore, a redundant, secondary closing means is arranged. Between the lower end 7 of the valve bore 5, and the lower sleeve end 15, a secondary hydraulic closing chamber 43 is arranged. A secondary hydraulic closing channel 45 provides fluid communication between a hydraulic fluid source and the secondary hydraulic closing chamber 43. Thus, if for some reason, the operator is unable to close the AIV assembly 1 by using the primary means, namely by applying hydraulic pressure to the primary hydraulic closing chamber 33, he may actuate the sliding sleeve 11 by applying hydraulic pressure inside the secondary hydraulic closing chamber 43.

Correspondingly, a redundant or secondary means of opening the AIV assembly 1 exists, in case the operator, for some reason, is unable to open the AIV assembly 1 by applying hydraulic pressure inside the primary hydraulic opening chamber 29. As a secondary means for actuating the sliding sleeve 11 in the axially downward direction, he may bleed off the primary hydraulic closing chamber 33 and the secondary hydraulic closing chamber 43. Then he may apply fluid pressure inside the sleeve bore 13. Since the sleeve ports 17 face in a radial direction, while the axially facing fluid port 47 faces in an axial direction, a fluid pressure within the sleeve bore 13 will exert a downwardly directed force onto the sliding sleeve 11. Hence, the sliding sleeve 11 may move down into the open position (FIG. 6), in which the sleeve ports 17 are aligned with the fluid mouths 9 of the valve bore 5. To prevent that a vacuum in the primary hydraulic opening chamber 29 counteracts movement of the sliding sleeve 11 towards the open position, one may advantageously ventilate that chamber.

In the embodiment discussed above with reference to FIG. 1 to FIG. 6, the AIV assembly 1 is embedded within the main body 3 of the tubing hanger 100. In the following, another embodiment of an AIV assembly 1 is described with reference to FIG. 7 to FIG. 10. In this embodiment, the AIV assembly 1 is externally mounted below the main body 3 of the tubing hanger 100.

Figure 7:
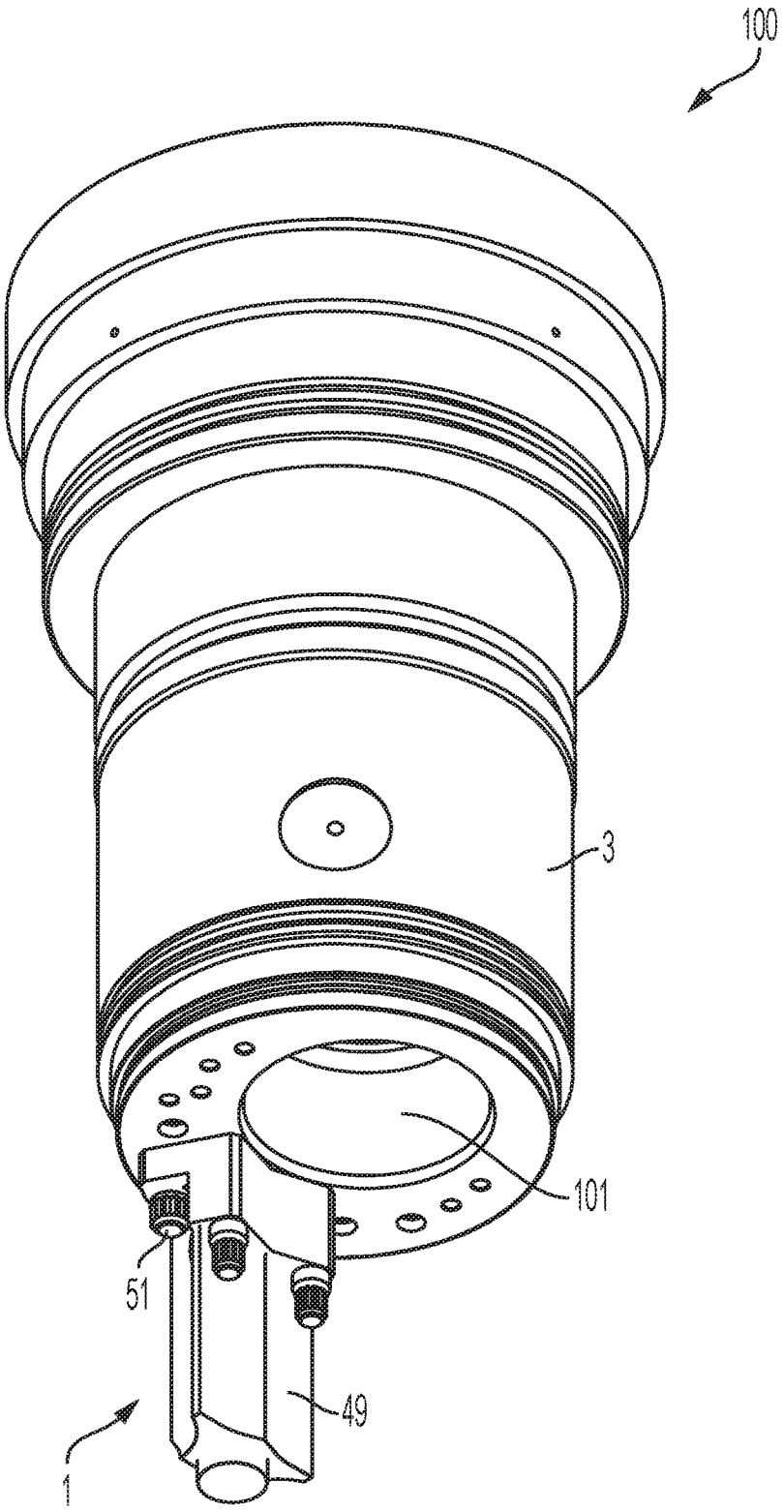
FIG. 7 is a perspective view of another embodiment of tubing hanger assembly comprising an annulus isolation valve assembly according to the invention.
Figure 8:
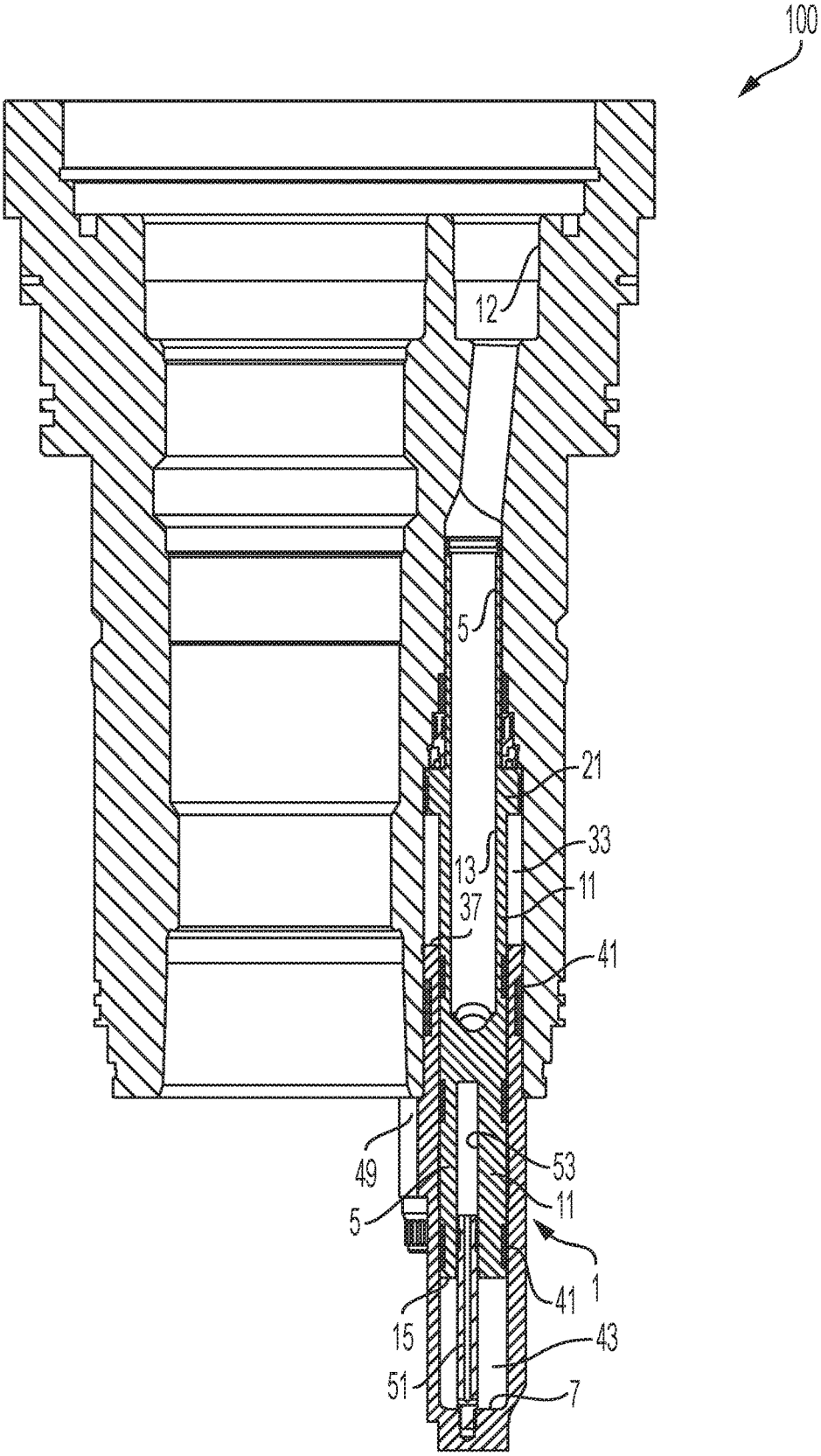
FIG. 8 is a cross section view through the tubing hanger assembly shown in FIG. 7.

The perspective view of FIG. 7 shows a tubing hanger 100 having a main body 3 and a production bore 101. Bolted to the lower portion of the main body 3 is a valve body 49 which is bolted to the main body 3 by means of bolts 51. The cross section view of FIG. 8 depicts the tubing hanger 100 shown in FIG. 7. Here, the stinger interface 12 in the upper portion of the tubing hanger 100 is axially remote from the AIV assembly 1.

Figure 9:
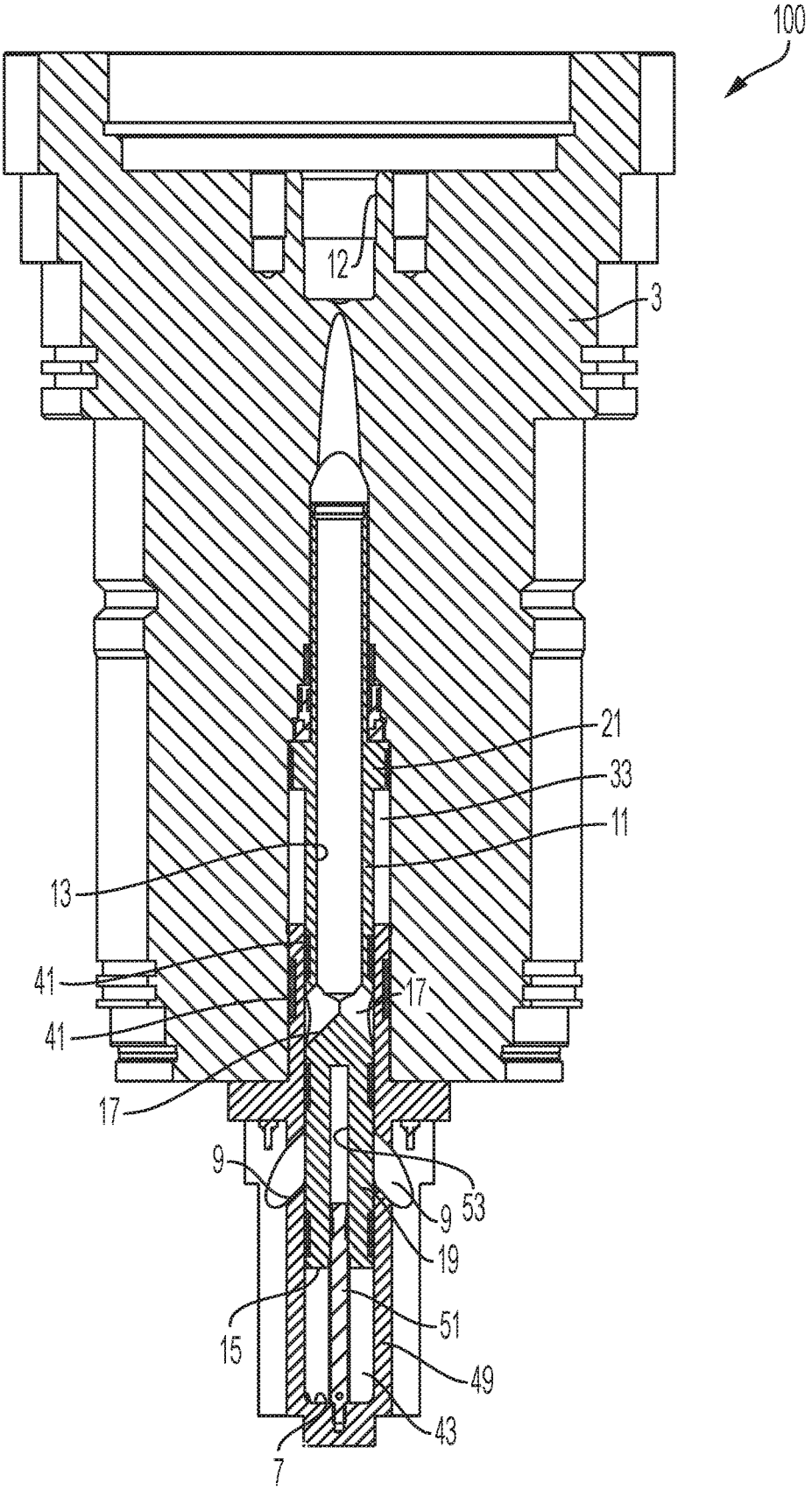
FIG. 9 is another cross section view through the tubing hanger assembly shown in FIG. 8, seen in a direction perpendicular to the direction in FIG. 8 and showing the annulus isolation valve assembly in a closed mode.
Figure 10:
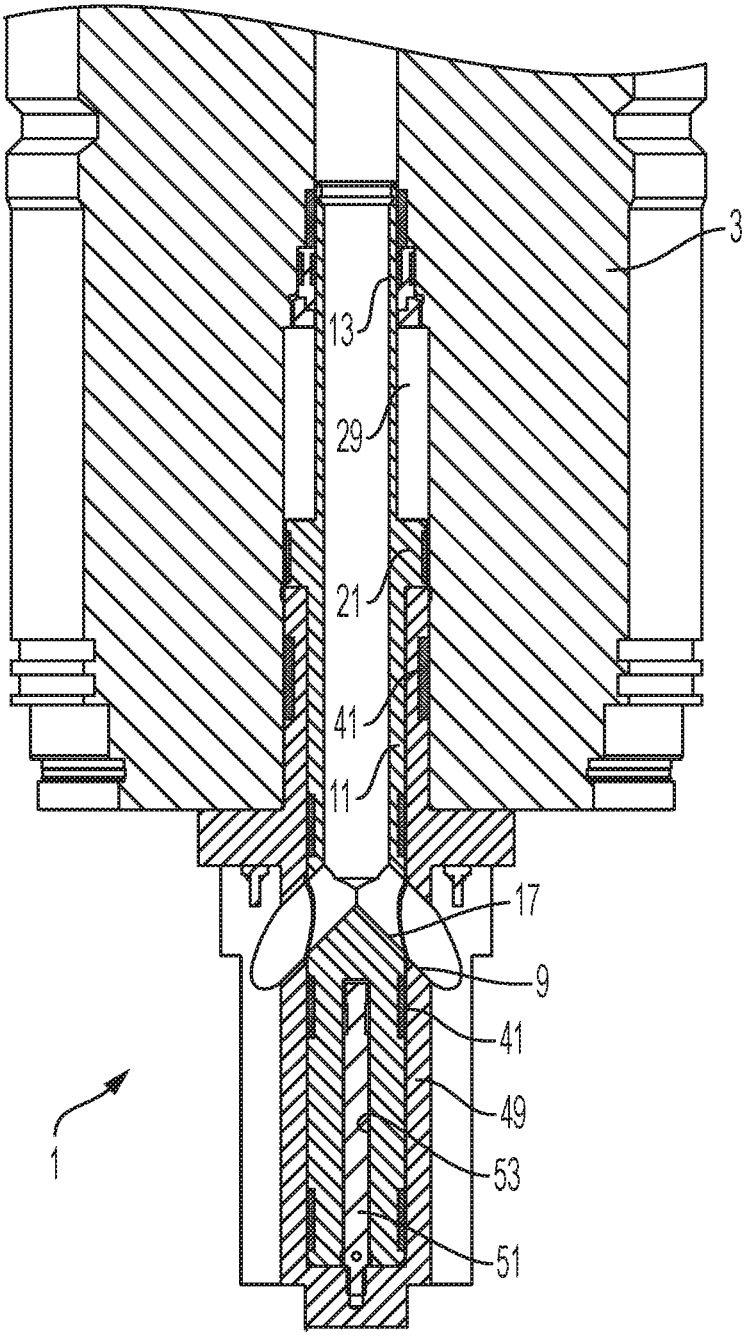
FIG. 10 is an enlarged cross section view corresponding to the view of FIG. 9, however showing the annulus isolation valve assembly in an open mode.

The function of the AIV assembly 1 shown in this second embodiment corresponds to the function of the embodiment discussed above with reference to FIG. 1 to FIG. 6. The AIV assembly 1 has a sliding sleeve 11 which reciprocates within a valve bore 5. The cross section view of FIG. 9 shows the sliding sleeve 11 in an upper position, which is a closed position. The cross section view of FIG. 10 shows the sliding sleeve 11 in a lower position, which is an open position.

Corresponding to the first discussed embodiment, this embodiment of the AIV valve 1 also has a primary hydraulic closing chamber 33, a primary hydraulic opening chamber 29, as well as a secondary hydraulic closing chamber 43.

Moreover, by bleeding off the hydraulic chambers, the operator may use pressure within the sleeve bore 13 to move the sliding sleeve downwards into the open position.

A pin 51 is fixed at the lower end 7 of the valve bore 5, and extends upwards into a pin-receiving bore 53 in the sliding sleeve 11. As appears from the cross section view of FIG. 8, the pin 51 and the pin-receiving bore 53 is eccentrically positioned with respect to the valve bore 5 and the sliding sleeve 11. In this embodiment, the valve bore 5 and the sliding sleeve 11 are concentrically designed. Thus, the pin 51 prevents a rotation of the sliding sleeve 11 within the valve bore 5. The prevention of such rotation is to ensure that the sleeve ports 17 will align correctly with the fluid mouths 9.

In the embodiment discussed above, however, with reference to FIG. 1 to FIG. 6, the valve bore 5 and the sliding sleeve 11 are arranged with an eccentric cross section, which prevents rotation of the sliding sleeve 11.

In both of the embodiments described above, the sleeve ports 17 and the fluid mouths 9 are arranged at the respective ends of inclined fluid paths. One may, however, also have the sleeve ports 17 and the fluid mouths 9 designed as being the ends of radially extending fluid paths.

Figure 11:
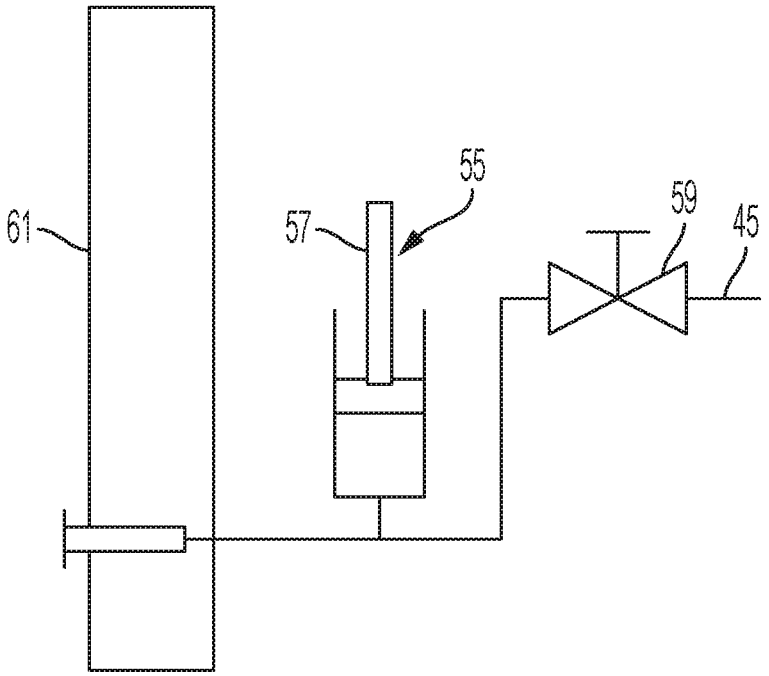
FIG. 11 is a schematic illustration of a secondary hydraulic closing channel, according to a particular embodiment.

FIG. 11 shows a possible feature which may be associated with the AIV assembly 1. As discussed above, the secondary hydraulic closing channel 45 connects to the secondary hydraulic closing chamber 43 (see e.g. FIG. 5). When the sliding sleeve 11 moves down into the open position (FIG. 6), hydraulic fluid within the secondary hydraulic closing chamber 43 is removed and must be accommodated outside the secondary hydraulic closing chamber 43. For this purpose, a piston compensator 55 is connected to the secondary hydraulic closing channel 45, to accommodate the said hydraulic fluid. According to this embodiment, the piston compensator 55 is provided with an indication means, here in the form of an indication pin 57. The position of the indication pin 57 will depend on the amount of hydraulic liquid which has been forced out from the secondary hydraulic closing chamber 43. Thus, by inspection of the position of the indication pin 57, the operator may confirm the position of the AIV assembly 1, i.e. if it is in the open or closed mode.

Still referring to FIG. 11, in the secondary hydraulic closing channel 45 is also arranged a secondary hydraulic closing channel valve 59. The secondary hydraulic closing channel valve 59 may be closed in order to lock the AIV assembly 1 in the closed mode, as hydraulic fluid within the secondary hydraulic closing chamber 43 will hydrostatically lock the sliding sleeve 11 in the closed position. Also shown in FIG. 11 is an ROV panel 61, adapted for engagement with an ROV.

Correspondingly, hydraulic channel valves may advantageously be arranged in the primary hydraulic closing channel 35 and the primary hydraulic opening channel 39. Such valves are typically check valves which are adapted to retain hydraulic fluid within their respective hydraulic chambers (e.g. chambers 43, 33, 29). Moreover, when a subsea Xmas tree lands above the tubing hanger 100, the check valves will open, rendering functions in the Xmas tree in control of the hydraulic fluid.

Figure 12:
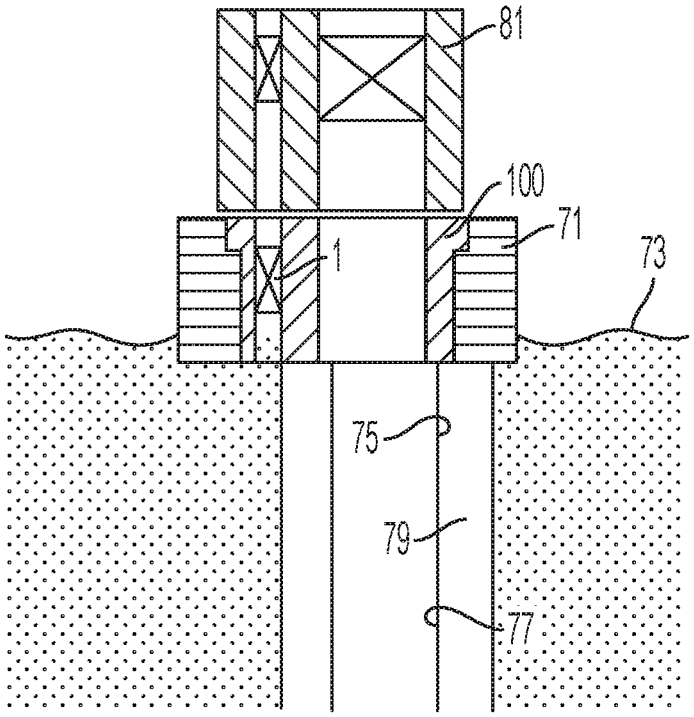
FIG. 12 is a principle drawing of a tubing hanger assembly installed within a wellhead on the seabed.

FIG. 12 is a schematic illustration of a subsea wellhead assembly having a subsea Xmas tree landed on it. A wellhead 71 is installed on the seabed 73. Within the wellhead 71, the tubing hanger assembly 100 has been landed. The tubing hanger assembly 100 has a production bore 101. Below the production bore 101 there is a production tubing 75 which extends into the subsea well 77. Outside the production tubing 75 is the tubing annulus 79. As schematically shown in FIG. 12, an AIV assembly 1 is arranged in fluid communication with the tubing annulus 79. On top of the tubing hanger assembly 100 there is landed a vertical subsea Xmas tree 81 having a production bore and an annulus bore, and associated valves. As known by the person skilled in the art, the production bore 101 of the tubing hanger assembly may be provided with valves, plug profiles or other means for closing the production bore. It is noted that FIG. 12 is merely a non-limiting schematic principle illustration in order to show the AIV assembly 1 in context.

The invention claimed is:

1. An annulus isolation valve assembly being part of a tubing hanger assembly, the annulus isolation valve assembly comprising:

a valve bore having a fluid mouth;

a sliding sleeve which is arranged in the valve bore and which has an axially extending sleeve bore, wherein the sliding sleeve comprises a radially facing sleeve port;

a hydraulic piston functionally connected to the sliding sleeve;

a primary hydraulic opening chamber disposed on a first side of the hydraulic piston and a primary hydraulic closing chamber disposed on a second side of the hydraulic piston;

a secondary hydraulic closing chamber confined by at least a closed sleeve end portion, a first end of the valve bore, and the valve bore;

wherein the sliding sleeve comprises an axially facing fluid port which is in fluid communication with the radially facing sleeve port;

wherein the radially facing sleeve port is arranged, in the axial direction, between the axially facing fluid port and the closed sleeve end portion; and wherein the annulus isolation valve assembly is arranged with a vertical or inclined orientation, and that the first end of the valve bore is a lower valve bore end, wherein a fixed insertion sleeve extends into the sleeve bore and defines a wall portion of the primary hydraulic opening chamber, and wherein the hydraulic piston is a collar protruding radially out from the sliding sleeve.

2. The annulus isolation valve assembly according to claim 1, wherein a piston compensator is in fluid communication with the primary hydraulic closing chamber or the secondary hydraulic closing chamber, and that the piston compensator comprises a position indication means.

3. The annulus isolation valve assembly according to claim 1, wherein the first end of the valve bore is in a valve body which is attached to a lower portion of a main body of the tubing hanger assembly.

* * * * *